United States Patent [19]

Gebhardt et al.

[11] 4,177,588

[45] Dec. 11, 1979

[54] INDICATING DEVICE

[75] Inventors: James L. Gebhardt, Roswell; Carlos L. Sanders, Atlanta, both of Ga.

[73] Assignee: The Mead Corporation, Dayton, Ohio

[21] Appl. No.: 899,360

[22] Filed: Apr. 24, 1978

[51] Int. Cl.[2] ..... G09F 11/21

[52] U.S. Cl. ..... 40/16.4; 40/518; 40/610; 40/618; 248/300

[58] Field of Search ..... 40/5, 10 R, 16, 16.2, 40/16.4, 16.6, 19.5, 489, 490, 491, 518, 609, 610, 618; 248/221.4, 235, 300, 309

[56] References Cited

U.S. PATENT DOCUMENTS

| | | | |
|---|---|---|---|
| 355,132 | 12/1886 | Brown et al. | 40/618 |
| 2,430,646 | 11/1947 | Ownbey | 40/618 |
| 3,939,584 | 2/1976 | Trame | 40/518 X |
| 4,090,315 | 5/1978 | Brown, Jr. et al. | 40/518 |

*Primary Examiner*—John F. Pitrelli
*Assistant Examiner*—G. Lee Skillington
*Attorney, Agent, or Firm*—Walter M. Rodgers; Walter A. Rodgers

[57] ABSTRACT

An indicating device such as is used to display automobile service station price data and such as is used as a score board for athletic events includes a suitable mounted base plate (1) (50) in which a plurality of slots (2–9) (51–56) are formed for receiving respectively a plurality of semirigid ribs **(35–38) (35*a*–38*a*) having rib mounting grooves (42,43) whereby the ribs are slidable longitudinally into the slots, each rib being provided with tape positioning grooves (44,45) for slidably receiving the edge portions of self coiling tapes (29–34) (66–70)** on which displayed indicia is applied and the tapes being manually adjustable so as to accommodate changes in the displayed data.

11 Claims, 12 Drawing Figures

INDICATING DEVICE

U.S. Pat. No. 4,136,473 issued Jan. 30, 1979 and owned by the assignee of this invention discloses and claims a manually adjustable indicating device such as a calendar and which includes a plurality of tapes formed of self coiling material and arranged so that a portion of each tape intermediate its ends is held in substantially flat condition against a substantially flat base plate by means of flanged ribs of T-shaped cross section which project outwardly from the base plate and which serve to overlie the edges of the tapes so as to hold the tapes in flat readily observable condition. The ribs and their associated flanges may be formed in any suitable manner and may be formed integrally with the base plate by means of a special extrusion process or may be mounted on the base plate by welding or the base plate itself may be specially configured so as to define flat areas interspersed between ribs which are T-shaped in cross section. Such procedures for applying ribs and associated flanges to a relatively thin base plate ordinarily are somewhat complicated and necessarily involve expensive and time consuming operations.

According to this invention, ribs are formed preferably of a suitable plastic extrusion and are configured for mounting respectively in a plurality of slots formed in a base plate and are provided with rib mounting grooves for receiving the side edges of the base plate slots and are also provided with tape positioning grooves spaced from the base plate for engaging the side edges of indicating tapes such as self coiling tapes having indicating indicia thereon. According to one feature of the invention and in order to facilitate insertion of the extruded ribs into the slots formed in the base plate, each base plate slot is provided with an enlarged end portion. Furthermore according to certain aspects of the invention, the displays may be observable from opposite sides of the base plate such feature being useful when used in conjunction with automobile service station price display signs or, if desired, the invention is adaptable for providing a display which is observable from only one side when employed, for example, in conjunction with score boards used at athletic events.

For a better understanding of the invention reference may be had to the following detailed description taken in conjunction with the accompanying drawings in which FIG. 1 is an isometric view of an automobile service station price indicating sign constructed according to the invention;

FIG. 11 is an end view of FIG. 10 and in which

Figure 1:
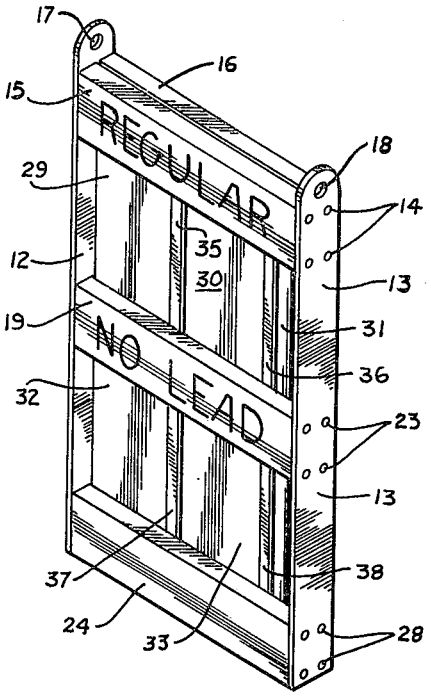
Figure 2:
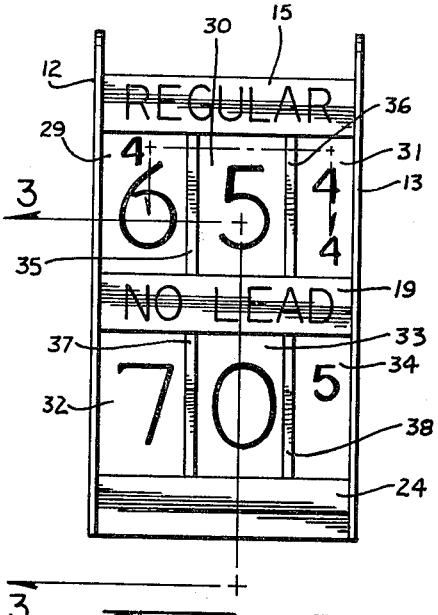
FIG. 2 is a front view of the arrangement shown in FIG. 1.
Figure 3:
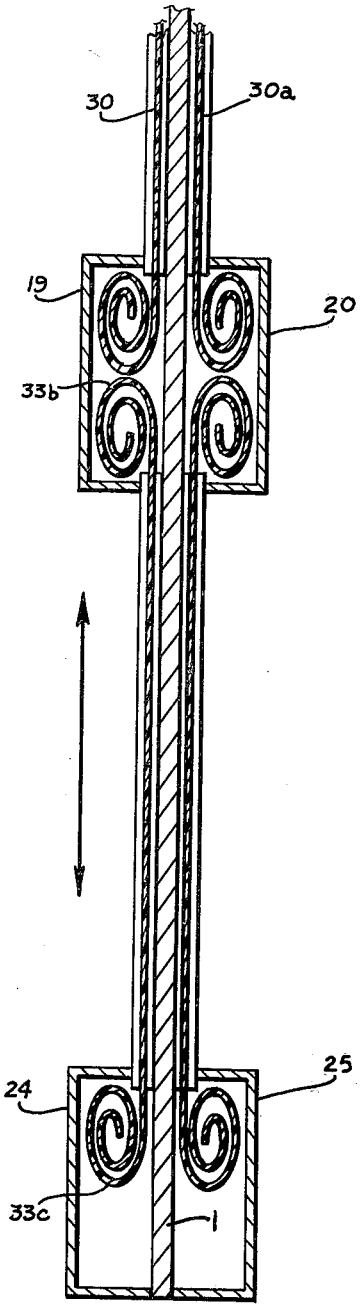
FIG. 3 is a cross sectional view taken along the line designated 3—3 in FIG. 2.
Figure 4:
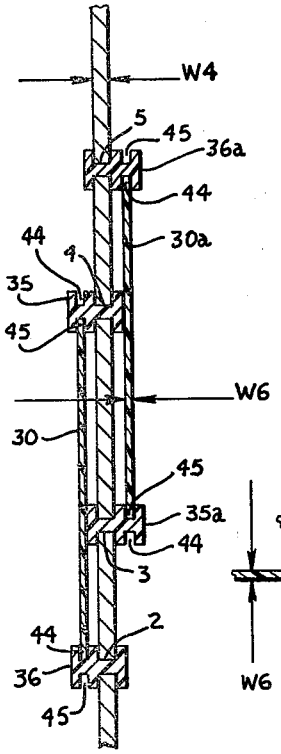
FIG. 4 is a cross sectional view taken along the line designated 4—4 in FIG. 2.
Figure 5:
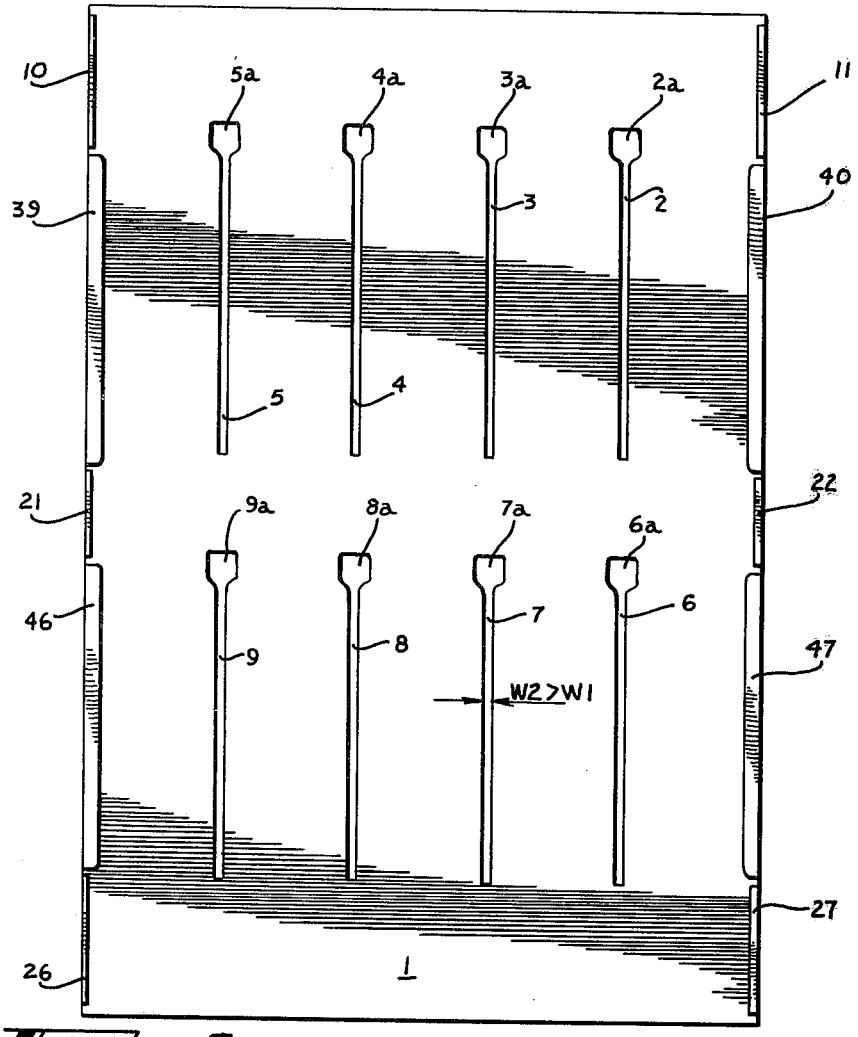
FIG. 5 is a plan view of a flat base plate formed according to one aspect of the invention and which is especially adapted for use in conjunction with an automobile service station price sign such as that represented in FIGS. 1–4 inclusive.

With reference to the filling station sign depicted in FIG. 1–5 inclusive, the numeral 1 generally designates a substantially flat base plate formed according to the invention and in which a plurality of slots 2–9 inclusive are formed. These slots, as is apparent particularly from FIG. 5, are provided with enlarged rectangular end portions *2a–9a* inclusive. Formed along the side edges of base plate 1 at the upper part thereof is a pair of fastening flanges 10 and 11 to which the upright side pieces 12 and 13 are secured by any suitable means such as by the screws 14. A pair of channels 15 and 16 are interposed between the uprights 12 and 13 and are secured in place by means of screws 14 or by any other suitable means. If desired the screws 14 could be inserted through apertures formed in the vertical panels of channels 15 and 16 and the fastening flanges 10 and 11 could be constructed to receive the screws. Also, suitable projections with apertures therein could be formed on side pieces 12 and 13 for receiving screws 14. The sign if suspended by any suitable means such as from the openings 17 and 18 formed in the side peices 12 and 13 respectively. Also secured to the uprights 12 and 13 is a pair of intermediate channels only one of which is observable in FIGS. 1 and 2 and which is designated by the numeral 19. The cooperating channel is shown in FIG. 3 and designated by the numeral 20. Channels 19 and 20 are secured to the side pieces 12 and 13 and to the fastening flanges 21 and 22 of base plate 1 by means of screws 23. The screws 23 could be arranged in an alternative fashion as described in connection with screws 14 and associated parts. Similarly channels 24 and 25 are secured to the flanges 26 and 27 formed along the side edges of base plate 1 and to the uprights 12 and 13 by means of screws 28 which could be rearranged as discussed in connection with screws 14 and 23. The horizontal or flange panels of channels 15, 16, 19, 20, 24 and 25 could be bevelled to form a gabled or roof-top structure which would inhibit the accumulation of sleet and snow and to facilitate runoff of rain if desired.

As is apparent from FIGS. 1, 2, 3 and 4, a plurality of tapes having indicating indicia formed thereon are mounted on opposite sides of the base plate 1. These tapes on one side of base plate 1 are designated by the numerals 29–34. From FIG. 3 it is apparent that the coiled upper end *33b* of tape 33 is housed in channel 19 while the lower coiled end of tape 33 designated *33c* is housed within channel 24. Obviously these tapes may be manually adjusted up and down since the tapes are of the self coiling type so that observable indicia printed along the length of the tape may be changed as desired. The opposite side of the sign includes a similar arrangement of tapes arranged for viewing from the opposite direction.

Figure 11:
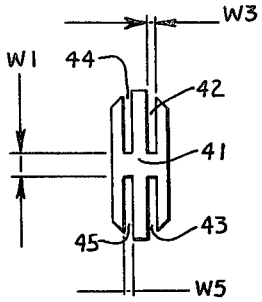
Figure 12:
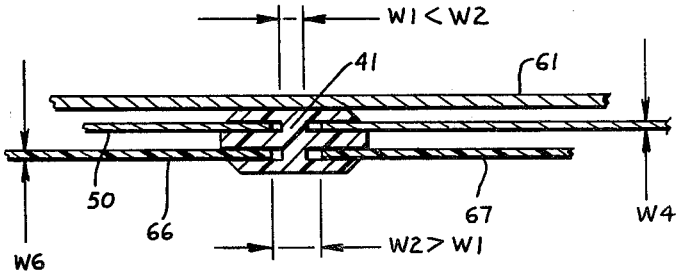
FIG. 12 is an enlarged detailed cross-sectional view taken along the line designated 12—12 in FIG. 6.
Figure 9:
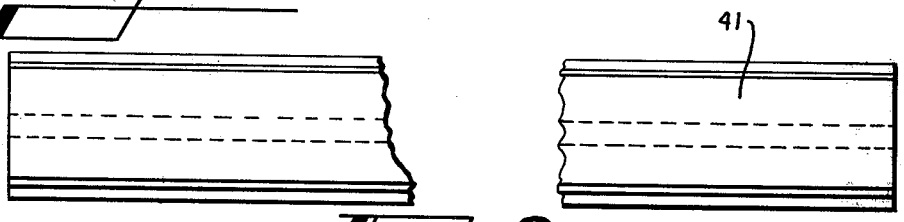
FIG. 9 is a view of the end portions of an elongated rib formed according to one aspect of the invention.
Figure 10:
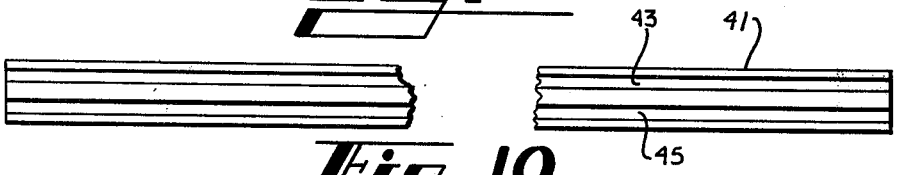
FIG. 10 is a side view of the elongated rib shown in FIG. 9.

For holding the intermediate portion of the tapes in flat generally parallel relation to the flat base plate 1, grooved ribs 35, 36, 37, and 38 are provided. These ribs are elongated structures which are approximately the same length as the slots such as 2–9 inclusive. As best shown in FIGS. 9, 10 and 11, the ribs include a central medial strut 41 together with a pair of rib positioning grooves 42 and 43 as well as a pair of tape positioning grooves 44 and 45. Thus in order to mount a rib such as 35 in a groove such as 4 for example an end of the rib is inserted into the enlarged end portion 4*a* in such manner that the rib mounting grooves 42 and 43 slidably receive the portions of base plate 1 which define the main parallel elongated side edges of the slot 4. Of course this inserting operation may require a slight bending of base plate 1 or of the rib or of both, the rib being formed of semirigid material. Once the rib is fully inserted into the slot 4, it is then in a position such that the right hand edge of tape 29 is slidable within the tape positioning groove 45 while the left hand edge of tape 30 is slidably positioned within the tape positioning groove 44. Obviously the rib such as 36 which is inserted within the slot 2 is arranged so that the right hand edge of tape 30 is slidable within the tape positioning groove 45 of the rib within slot 2 while the left hand edge of tape 31 is slidable within the tape positioning groove 44 of the rib mounted in slot 2.

In similar manner ribs are inserted into slots 8 and 6 and together with fixed flanges 46 and 47 serve to capture the edges of tapes 32, 33 and 34 as will be obvious.

As is apparent particularly from FIG. 2 and in connection with tapes 29, 30 and 31 on which the price of regular gasoline is indicated as 65 and 4/10 cents a gallon, tape 31 is considerably narrower than are tapes 29 and 30. Thus the sign of FIGS. 1 and 2 when viewed from the opposite side is arranged so that the tape 29 for the tens indicia "6" is between the rib mounted in slot 3 and the companion fixed flange 40. Tape 30*a* having units indicia "5" is disposed between the ribs in slots 3 and 5 and tape bearing the "tenths" indicia "4" is disposed between the rib in slot 5 and the companion flange to flange 39. The ribs which are inserted within slots 3 and 5 are arranged so that their tape positioning grooves 44 and 45 are disposed on the opposite side of the base plate 1 from the disposition of the tape positioning grooves formed in the ribs which are disposed within slots 2 and 4 as is obvious. This condition is represented by FIG. 4. As is apparent from FIG. 4 where the tape 30 is shown as associated with the ribs 35 and 36, these ribs are respectively mounted within slots 4 and 2 while the ribs 35*a* and 36*a* for use with tape 30*a* on the rear of the sign are disposed in slots 3 and 5 and receive the edges of tape 30*a*. Thus the ribs 35 and 36 are arranged with their tape positioning grooves 44 and 45 disposed on the left side of base panel 1 as viewed in FIG. 4 while the ribs 35*a* and 36*a* disposed within slots 3 and 5 are arranged with their tape positioning grooves 44 and 45 on the right side of the base plate 1 so that the portion of rib 35 for example which protrudes toward the right of base panel 1 is covered by tape 30*a*. Similarly the portion of the rib 35*a* which protrudes to the left of panel 1 in slot 3 is covered by tape 30 so that according to one facet of the invention the arrangement is such that the sign appears identical from opposite vantage points. Of course the medial strut 41 of each rib must be slightly narrower in width indicated at W1 than is the width W2 of the slots 2–9 in in order to accommodate sliding movement of the ribs into the slots. Also the thickness W3 of the rib mounting grooves must be slightly greater than the thickness W4 of the base plate 1. Similarly the thickness W5 of the tape positioning grooves such as 44 and 45 must be slightly greater than the thickness W6 of the tapes in order to accommodate sliding movement of the tapes relative to the grooves.

While the automobile service station price sign described above is especially adapted to provide readily observable and easily adjustable price indicia which is observable from opposite vantage points, an indicating device such as a score board need be observed from only one general direction. Such a device is represented in FIGS. 6, 7 and 8.

Figure 8:
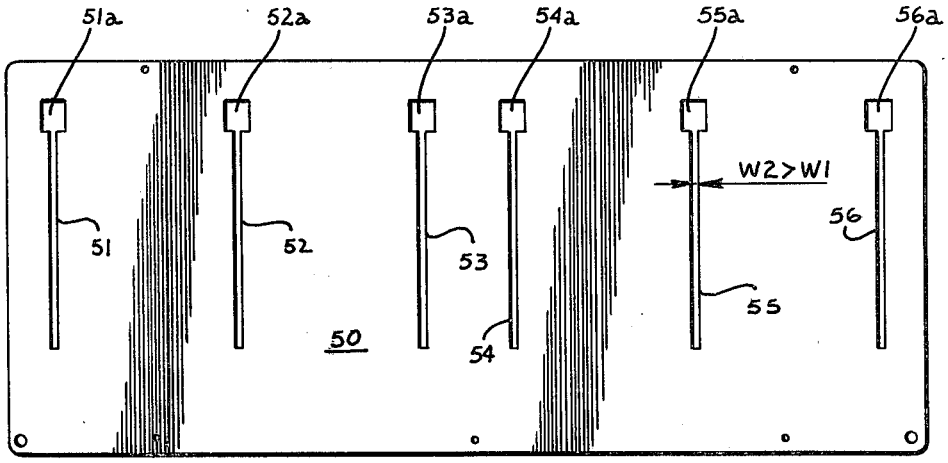
FIG. 8 is a plan view of a slotted flat base plate constituting a part of the score board shown in FIGS. 6 and 7.
Figure 6:
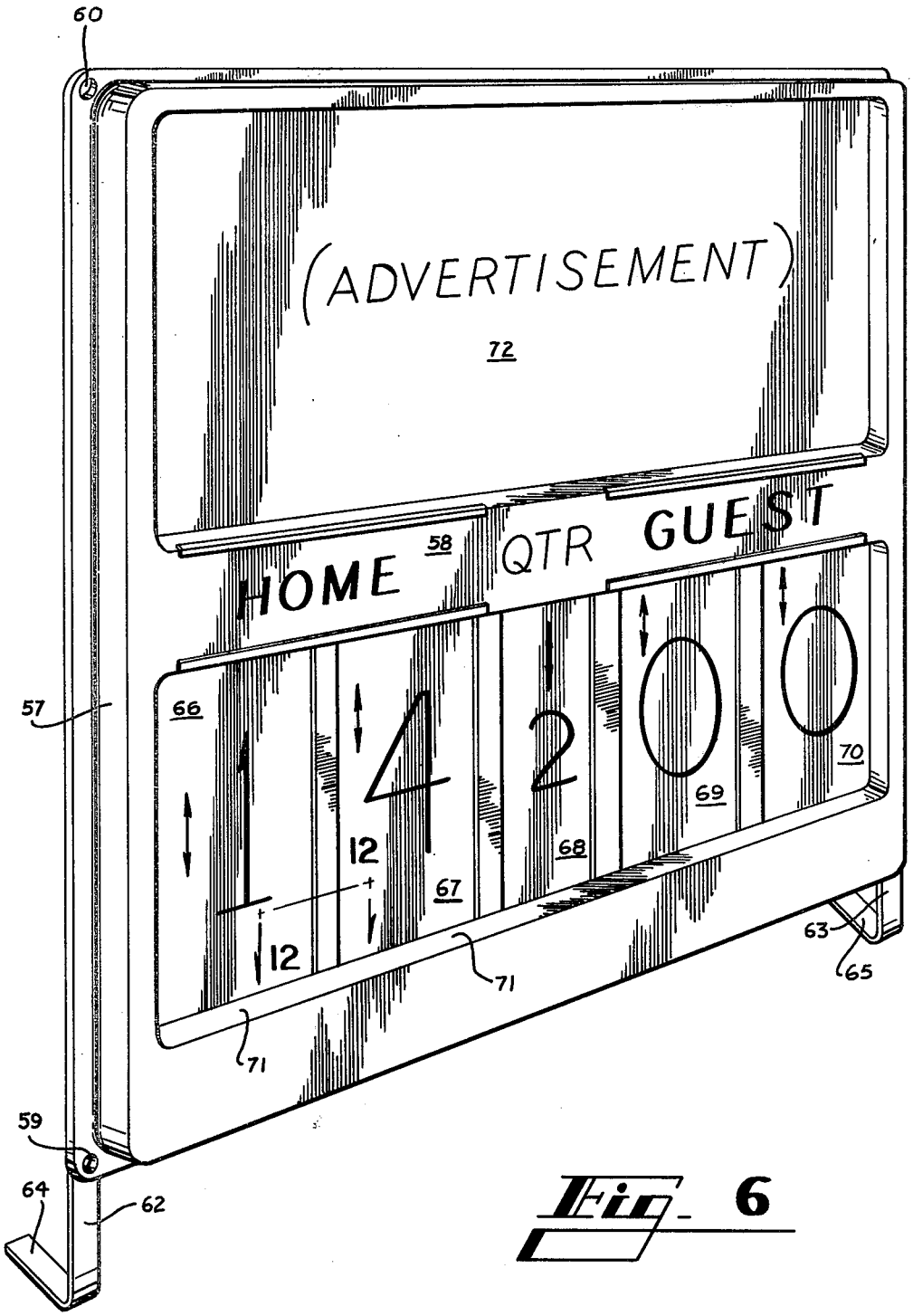
FIG. 6 is an isometric view of an indicating device such as a score board for indicating the scores of contestants in an athletic event.
Figure 7:
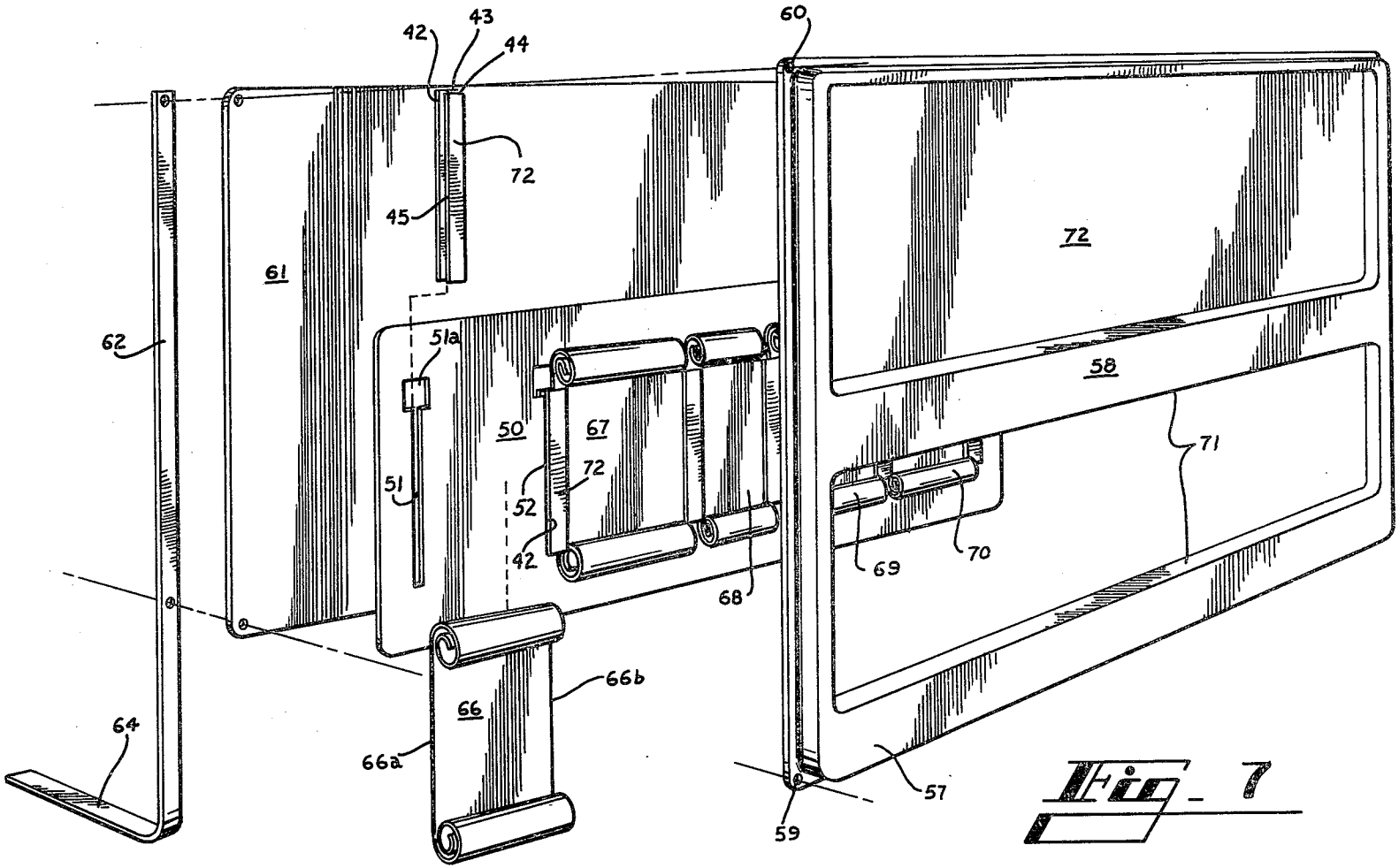
FIG. 7 is an exploded view of the structure shown assembled in FIG. 6.

The football score board depicted in FIGS. 6, 7 and 8 includes a flat base plate 50 provided with elongated slots 51–56 having rectangular enlarged end portions 51*a*–56a inclusive. Base plate 50 is supported within forwardly projecting portion 57 of front structure generally designated by the numeral 58 which structure is secured by a suitable bolt at each corner only two of which 59 and 60 are observable in the drawings. These corner bolts extend through a back plate 61 and engage a pair of upright supports 62 and 63 which are provided with foot portions 64 and 65.

A plurality of self coiling tapes 66–70 are mounted by suitable ribs such as are shown in FIGS. 9–11 to the base plate 50 and are observable through window 71 formed in the frame 58. Suitable advertising data may be displayed on the large panel designated 72.

The rib such as that designated by the numeral 72 in FIG. 7 is inserted through the enlarged end 51*a* into the slot 51. The rib positioning grooves 42 and 43 slidably receive the opposite edges of the straight portion of slot 51 and, as before, the semirigid extruded plastic rib 72 or base plate 50 or both may be bent slightly during the inserting operation. With the rib 72 properly positioned, its tape positioning grooves 44 and 45 are disposed in front of the base plate 50 and in parallel relation thereto. Thus the left hand edge 66*a* of tape 66 is slidable within the tape positioning groove 44 of rib 72. Similarly the right hand edge 66*b* of tape 66 is slidable within the tape positioning groove 45 of a rib inserted within the slot 52. In like manner the tapes 67, 68, 69 and 70 are mounted and the tapes may serve for example to indicate the score of the home team and of the guest team and intermediate these two two-digit displays, the quarter designation such as 2 may be indicated. It may be desirable to provide a greater or smaller number of tapes than the four shown and described. Such a change of course is within the scope and contemplation of the invention and could be made in such manner as to adapt the score board for use with different games such as baseball and other games.

Of course the width of the medial strut 41 as indicated at W1 in FIG. 11 must be slightly less than the width indicated at W2 in FIG. 8 in connection with slot 55 and in FIG. 5 in connection with slot 7 in order to accommodate sliding movement of the ribs relative to the slots. In like fashion the width of the rib mounting grooves 42 and 43 as indicated at W3 must be somewhat greater than the thickness W4 of the base plates such as 1 and 50 in order to accommodate sliding movement of the ribs in the grooves. Similarly the tape positioning grooves 44 and 45 must be of a width W5 which is slightly greater than the thickness W6 of the tapes to accommodate sliding movement of the tapes as is obvious.

From the above description it is apparent that by the invention utilizing the semirigid ribs and the substantially flat somewhat bendable slotted base plates with enlarged end portions, substantial economies are effected when such structure is compared with conventional techniques which require welding of a rib with an associated flange to the base plate or which require special and complicated formation techniques to cause the base plate to be configured in such manner as to define the flanged ribs. In addition the structure provided by the invention is characterized by a high degree of safety because the ribs which normally are of extruded plastic material do not have sharp dangerous edges which could pose a hazard to the assembler of the apparatus as well as to the user thereof who is required manually to adjust the tapes in order to change the indicia displayed thereon.

The embodiments of the invention in which an exclusive property or privilege is claimed are defined as follows:

1. An indicating device comprising a substantially flat base plate, an elongated slot formed in said base plate, a semirigid elongated rib having a central axial strut and a pair of parallel elongated rib mounting grooves formed in said rib, the length of said rib being substantially equal to the length of said slot, said grooves being disposed on opposite sides of said strut, said strut being of a width somewhat less than the width of said slot, and the width of said grooves being somewhat greater than the thickness of said base plate whereby said rib is slidable longitudinally in said slot with the edges thereof disposed in said grooves.

2. A device according to claim 1 wherein said slot is defined by substantially parallel side edges for a major portion of its length and by an enlarged portion at one end thereof for facilitating slidable entry of said rib into said slot at said one end thereof.

3. A device according to claim 2 wherein said enlarged end portion is of generally rectangular configuration.

4. An indicating device comprising a substantially flat base plate, an elongated slot formed in said base plate, a semirigid elongated rib having a central axial strut and a pair of parallel elongated rib mounting grooves formed in said rib, said rib mounting grooves being disposed on opposite sides of said strut, said strut being of a width somewhat less than the width of said slot, the width of said rib mounting grooves being somewhat greater than the thickness of said base plate whereby said rib is slidable longitudinally in said slot with the edges thereof disposed in said rib mounting grooves, and at least one tape positioning groove formed in said rib in generally parallel relation to said base plate and spaced therefrom for slidably receiving a side edge of an indicating tape having indicating indicia thereon.

5. A device according to claim 4 wherein a cover plate is mounted on said base plate on the side thereof remote from said tape positioning groove and arranged in covering relation to the protruding portion of said rib.

6. A device according to claim 4 wherein a plurality of generally parallel spaced apart slots are formed in said base plate, a plurality of ribs are disposed respectively in said slots, and at least one tape is mounted with a part thereof generally parallel with said base plate and with its side edges disposed in adjacent tape positioning grooves of adjacent ribs respectively.

7. A device according to claim 4 wherein two tape partitioning grooves are formed in said rib on opposite sides thereof and in generally parallel relation to and spaced from said base plate.

8. A device according to claim 7 wherein a plurality of generally parallel spaced apart slots are formed in said base plate, a plurality of ribs are disposed respectively in said slots, said ribs being oriented so that the parts of some of said ribs in which said tape positioning grooves are formed are disposed on one side of said base plate and so that the parts of other of said ribs in which said tape positioning grooves are formed are disposed on the other side of said base plate.

9. A device according to claim 8 wherein at least one indicating tape is mounted on said one side of said base plate with its side edges disposed within said tape positioning grooves of adjacent ribs on said one side of said base plate and at least one indicating tape is mounted on the other side of said base plate with its side edges disposed within said tape positioning grooves of adjacent ribs on said other side of said base plate.

10. A device according to claim 9 wherein a plurality of indicating tapes of nonuniform widths are mounted on each side of said base plate.

11. A device according to claim 10 wherein the tapes on one side of said base plate are out of coincidence with the tapes on the other side of said base plate.

* * * * *